United States Patent [19]

Beckham et al.

[11] Patent Number: 4,720,257

[45] Date of Patent: Jan. 19, 1988

[54] BURNER FOR CAMPSTOVE

[75] Inventors: Hugh Beckham; Richard Curtis, both of Wichita, Kans.

[73] Assignee: The Coleman Company, Inc., Wichita, Kans.

[21] Appl. No.: 887,442

[22] Filed: Jul. 21, 1986

[51] Int. Cl.[4] ..... F23D 11/44

[52] U.S. Cl. ..... 431/211; 431/218; 126/44; 239/555

[58] Field of Search ..... 431/211, 218, 222, 225; 126/44; 239/555, 567

[56] References Cited

U.S. PATENT DOCUMENTS 2,491,430 12/1949 Tullis ..... 126/44

FOREIGN PATENT DOCUMENTS 660993 2/1929 France ..... 431/211

*Primary Examiner*—Carroll B. Dority, Jr.

[57] ABSTRACT

A campstove burner includes a burner box which is located above the burner pan of the burner. The burner rings are positioned between the burner pan and the burner box, and a fuel and air mixture within the burner box flows through the burner rings where it is ignited. Since the burner box is located above the burner pan, liquid fuel within the burner box will flow through the burner rings and will be ignited in the burner pan outside of the burner box. The burner box includes a cylindrical sidewall which surrounds an upwardly extending cylindrical central portion of the burner pan to provide an annular mixing chamber An opening is provided in the cylindrical central portion of the burner pan, and a fuel tube extends into the cylindrical portion of the burner pan and directs fuel flow toward the opening. Fuel and air flow through the opening, and a portion of the fuel and air is deflected by the cylindrical wall of the burner box back through the opening to promote mixing.

15 Claims, 7 Drawing Figures

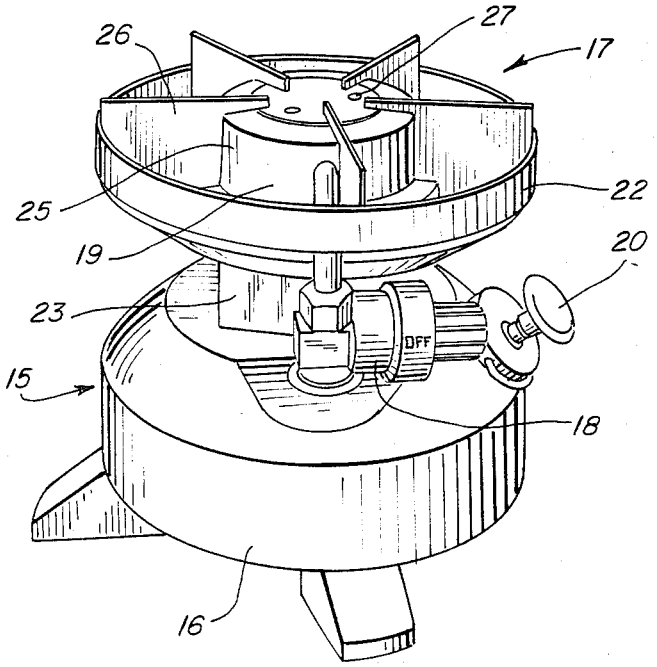
FIG. 1
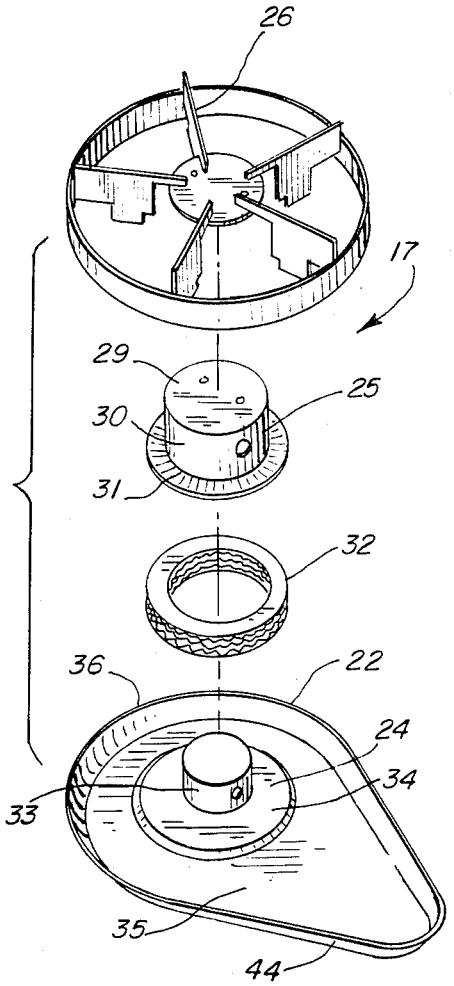
FIG. 2
FIG. 3
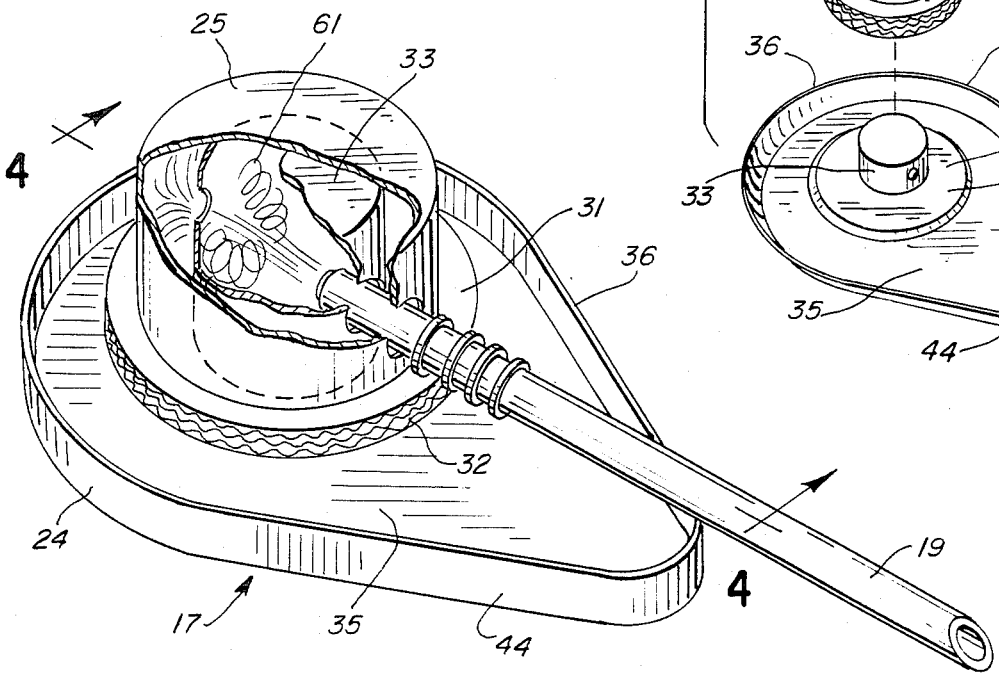

FIG. 4
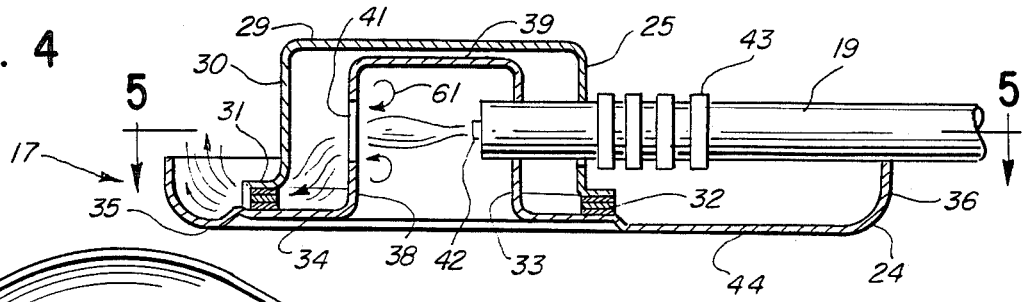
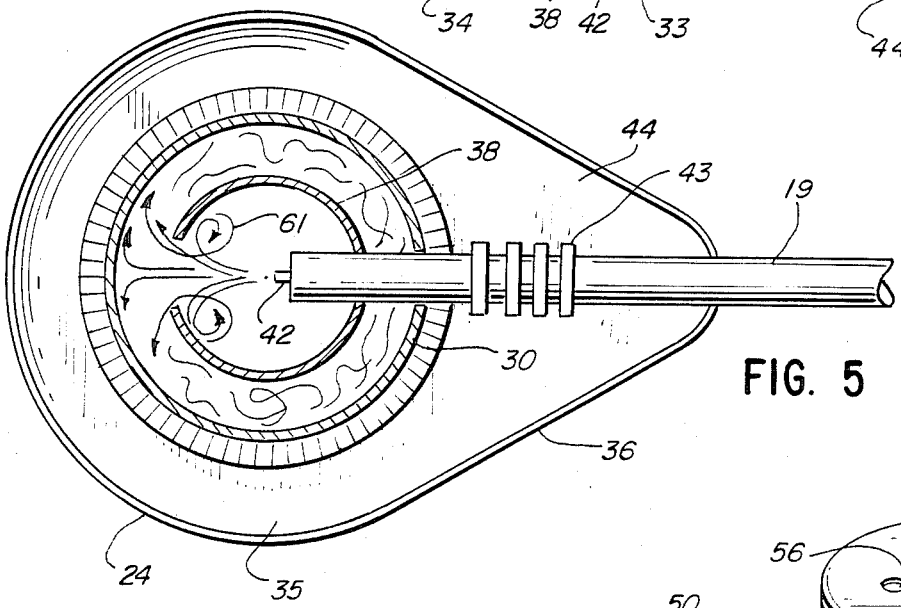
FIG. 5
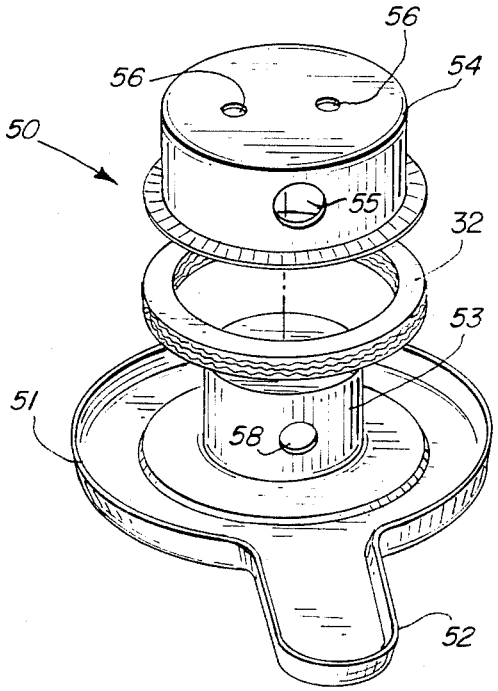
FIG. 6
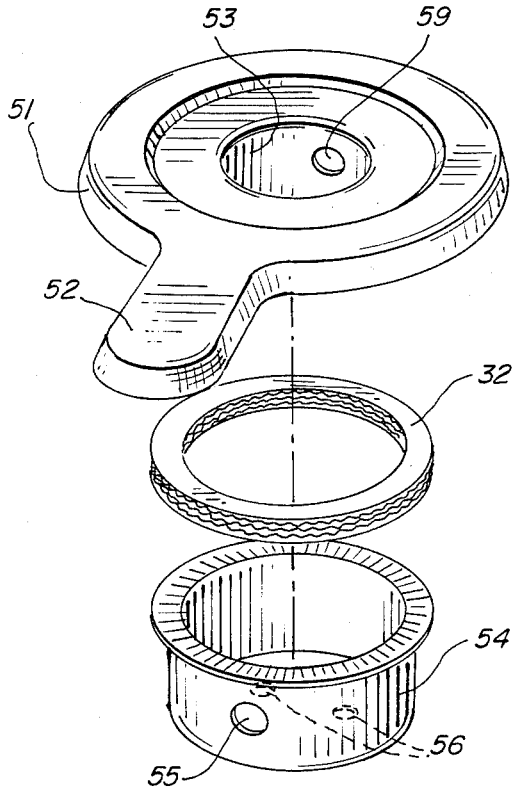
FIG. 7

BURNER FOR CAMPSTOVE

BACKGROUND

This invention relates to campstoves, and, more particularly, to improved burner assemblies for campstoves.

Campstoves which use liquid fuel typically include a burner assembly in which a burner box for mixing fuel and air is located below the burner. A generator tube delivers vaporized fuel to the burner, and a fuel and air mixture flows upwardly from the burner box to the burner where it is ignited. U.S. Pat. No. 4,126,117 (reisued as Patent Re. 31,738) describes this type of campstove.

U.S. Pat. No. 3,933,146 describes a campstove which uses propane fuel. This campstove also includes a burner box which is positioned below the burner.

In conventional liquid fuel burner assemblies in which the burner box is positioned below the burner, any fuel which is ejected from the generator tube in a liquid state collects in the bottom of the burner box away from the burner. The possibility of liquid fuel collecting in the burner box is even greater in cold temperatures. A substantial period of time can elapse before this liquid fuel is vaporized and reaches the burner, and the efficiency of the burner assembly is thereby reduced.

Flooding of the burner box with liquid fuel also interferes with the start-up of the burner assembly. Campstoves are commonly provided with an instant-light fuel supply mechanism which supplies a fuel-air mixture to the generator tube so that the burner can be ignited before the generator tube is heated sufficiently to vaporize the fuel in the generator tube. After the burner is ignited and heats the generator tube sufficiently to vaporize the fuel in the generator tube, the instant-light mechanism is turned off and only fuel flows through the generator tube. Liquid fuel which collects in the burner box during start-up is not available for combustion at the burner, and more time is required to heat the generator before the instant-light mechanism can be turned off. Since the burner burns less efficiently during start-up and emits less heat, a short start-up time is desirable.

Conventional burner assemblies also include means for mixing fuel and air and delivering the fuel-air mixture to the burner for combustion. It is important that the fuel and air are mixed thoroughly before ignition to provide a properly carbureated fuel mix for optimum efficiency, i.e., the smallest amount of fuel for a given BTU output.

SUMMARY OF INVENTION

The invention provides an improved burner assembly for mixing fuel and air. The burner assembly includes a burner pan which supports the burner rings, and the burner pan includes a cup-shaped central portion which extends upwardly into the burner box to provide an annular mixing chamber between the burner box and the cup-shaped portion of the burner pan. An opening is provided in the cylindrical sidewall of the cup-shaped portion, and the generator tube extends into the cup-shaped portion diametrically opposite of the opening. Fuel which flows from the generator tube mixes with combustion air in the cup-shaped portion and flows through the opening. A portion of the fuel-air mixture rebounds from the wall of the burner box back through the opening and undergoes additional mixing in the cup-shaped portion. The fuel and air mixture in the annular mixing chamber flows to the burner for combustion. This burner box assembly eliminates the need or a venturi or aspirator, resulting in a compact, economical, and reliable burner box.

Any liquid fuel which flows into the annular mixing chamber during start-up falls downwardly to the burner pan and flows through the burner rings for combustion along with the properly mixed fuel-air mixture.

DESCRIPTION OF THE DRAWING

The invention will be explained in conjunction with an illustrative embodiment shown in the accompanying drawing in which FIG. 1 is a camp stove equipped with a burner assembly in accordance with the invention.

FIG. 2 is a partially exploded view of the burner assembly of FIG. 1.

FIG. 3 is a fragmentary perspective view of the burner assembly of FIG. 1;

FIG. 4 is a fragmentary sectional view taken along the line 4—4 of FIG. 3;

FIG. 5 is a fragmentary sectional view taken along the line 5—5 of FIG. 4;

FIG. 6 is an exploded perspective view of a burner assembly similar to that of FIG. 3 with a modified burner pan;

FIG. 7 is an exploded bottom perspective view of the burner assembly of FIG. 6.

DESCRIPTION OF SPECIFIC EMBODIMENT

FIG. 1 illustrates a campstove 15 which includes a conventional fuel tank 16 and a burner assembly 17 which is mounted on the fuel tank. A fuel control valve 18 supplies fuel from the tank to a generator tube 19, and the generator tube supplies fuel to the burner assembly. The particular campstove illustrated is a liquid fuel campstove and includes an air pump 20 for pressurizing the air above the liquid fuel in the tank. It will be understood, however, that the invention can also be used with other types of campstoves, e.g., propane and butane campstoves.

Referring to FIG. 2, the burner assembly 17 includes a reflector bowl 22 which is supported by a mounting bracket 23 (FIG. 1) on the fuel tank. A burner 24 is supported generally concentrically on the reflector bowl, and a generally cup-shaped burner box or cap 25 is mounted on the burner pan. A grate 26 is supported by the burner box and the burner pan and the entire assembly is held together and attached to the mounting bracket 23 by screws 27 (FIG. 1).

Referring to FIGS. 3–5, the burner box 25 is cup-shaped and includes a top wall 29, a cylindrical sidewall 30, and an outwardly extending bottom flange 31. A plurality of corrugated burner rings 32 are positioned between the bottom flange 31 and the burner pan 24. The burner rings 32 are well known and are available from The Coleman Company, Inc., of Wichita, Kans., under the name "Band-A-Blu". Additional details of the burner rings are described in U.S. Pat. No. 3,933,146. As will be described more fully hereinafter, the corrugated burner rings provide a porous support for the burner box which enables fuel and air to flow outwardly from the burner box 25.

The burner pan 24 includes a generally cylindrical cup-shaped central portion 33, a flat annular central portion 34 which supports the burner rings 32, a generally annular portion 35 which provides a fuel-collecting trough below the annular portion 34, and an outer rim 36.

The cup-shaped central portion 33 of the burner pan includes a cylindrical wall 38 and a top wall 39. The cup-shaped central portion 33 communicates with ambient air through an opening in the reflector bowl.

The generator tube 19 extends through the cylindrical sidewall 30 of the burner box 25 and through the sidewall 38 of the cup-shaped central portion of the burner pan 24. An outlet opening 41 is provided in the sidewall 38 diametrically opposite of the generate tube. The generator tube includes a conventional nozzle 42 and fins 43 for increasing heat transfer to the fuel within the generator tube. The burner pan 24 is generally teardrop-shaped and includes a tail portion 44 which extends radially outwardly below the generator tube 40.

A modified burner assembly 50 is illustrated in FIGS. 6 and 7. The burner assembly 50 includes a keyhole shaped burner pan 51 which includes a projecting portion 52 which extends radially outwardly below the generator tube 40. The burner pan of FIGS. 3–5 is formed integrally by cold forming or the like, but the burner pan 51 includes a separate cup-shaped central portion 53 which is connected to the remainder of the burner pan by welding or brazing. The burner assembly 50 is otherwise identical to the burner assembly 17 of FIG. 3–5.

The burner box 54 of the burner assembly 50 is provided with an opening 55 for the generator tube 19 and screw holes 56 for mounting the burner assembly to the mounting bracket 23 of FIG. 1. The cup-shaped portion 53 of the burner pan 71 is provided with similar screw holes (not shown), an opening for the generator tube, and an opening 59 diametrically opposite the generator tube.

Fuel which is ejected by the generator tube 19 into the cup-shaped central portion 33 of FIG. 4 or the cup-shaped central portion 53 of FIG. 6 mixes with air within the cup-shaped portion and aspirates ambient air into the cup-shaped portion. The fuel-air mixture flows through the opening 41 or 59 in the cup-shaped portion, and into the annular mixing chamber between the cup-shaped portion and the burner box 25 or 54. A portion of the fuel-air mixture rebounds from the cylindrical sidewall of the burner box and flows back through the opening 41 or 59 into the cup-shaped central portion. The fuel is thereby subjected to further mixing with air within the cup-shaped central portion 33 or 53.

Although the precise mixing operation of the invention is not completely understood, it is believed that the fuel-air mixture which rebounds from the cylindrical sidewall of the burner box back through the opening 41 in FIGS. 3–5 forms a mushroom-shaped cloud 61 within the cup-shaped central portion 33. The cap of the mushroom swirls and forms a toroidal pattern whose axis extends coaxially with the axis of the generator tube. The pattern of swirling gases within the cup-shaped central portion 33 creates a partial vacuum and draws air into the toroid for further mixing. Fuel and air which escape through the opening 41 into the annular chamber between the cup-shaped central portion 33 and the burner box 25 is mixed further within the annular chamber before passing through the burner rings 32 for combustion. The swirling toroidal pattern 61 of the fuel-air mixture within the cup-shaped central portion 33 provides more complete and uniform mixing of the fuel and air, thereby enhancing the efficiency of the burner so as to decrease the amount of fuel consumed for a given BTU output.

The burner assembly 50 illustrated in FIGS. 6 and 7 operates in the same manner to provide a toroidal pattern of gases within the cup-shaped central portion 53 of the burner pan 51.

OPERATION OF THE BURNER ASSEMBLY

The campstove 15 includes a conventional instant-light mechanism for facilitating start-up of the burner. Such instant-light mechanisms are well known in the art and need not be described herein. When the instant-light mechanism is on, air in the fuel tank is entrained with liquid fuel, and a fuel-air mixture is ejected from the nozzle 42 at the end of the generator tube 19. The flow of the fuel-air mixture into the cup-shaped central portion 33 of the burner pan aspirates ambient air into the cup-shaped central portion and additional air is mixed with the fuel. The fuel-air mixture flows through the opening 41 and additional mixing occurs as the mixture swirls around the annular mixing chamber inside of the burner box. The fuel-air mixture eventually flows through the burner rings 32 where it is ignited. Heat from the burning fuel heats the generator tube 19, particularly the portion which extends over the tail portion 44 of burner pan 24, and the generator tube eventually becomes hot enough to vaporize the fuel passing therethrough. The instant-light mechanism can then be turned off. Vaporized fuel is then ejected from the nozzle of the generator tube into the cup-shaped central portion 33 of the burner pan.

Because the burner box 25 is located above the burner rings, any liquid fuel which exits the generator tube and falls to the annular central portion 34 of the burner pan 24 flows through the burner rings. The liquid fuel is either ignited at the outside of the burner rings or collects in the trough 35 of the burner pan where it ignites. Since even the liquid fuel which falls to the bottom of the burner box is ignited, all of the fuel is available for heating the generator tube, and the instant-light mechanism can be turned off relatively quickly.

While in the foregoing specification detailed descriptions of specific embodiments of the invention were set forth for the purpose of illustration, it will be understood that many of the details herein given may vary considerably by those skilled in the art without departing from the spirit and scope of the invention.

We claim:

1. A burner box assembly for a campstove burner comprising a generally cylindrical inner wall, a generally cylindrical outer wall surrounding the inner wall and providing an annular mixing chamber between the inner and outer wall, the cylindrical inner wall having an opening therein facing the cylindrical outer wall, a fuel tube within the inner wall for directing fuel toward the opening in the inner wall whereby said fuel mixes with air from within the inner wall and the fuel and air flow through the opening in the inner wall and a portion of the fuel and air is deflected by the outer wall and returned through the opening in the inner wall, and means for allowing fuel and air to flow from the annular mixing chamber.

2. The burner assembly of claim 1 in which the fuel tube extends through the cylindrical inner wall diametrically opposite the opening in the inner wall.

3. The burner assembly of claim 1 in which the fuel tube extends through the cylindrical outer wall, through the annular mixing chamber, and through the cylindrical inner wall diametrically opposite the opening in the inner wall.

4. The burner assembly of claim 1 including an end wall closing one end of the cylindrical inner wall, the other end of the cylindrical inner wall being open to ambient air.

5. The burner assembly of claim 1 including means for closing said annular mixing chamber and for directing fuel and air to said means for allowing fuel and air to flow from the burner.

6. The burner assembly of claim 1 including a burner pan below said outer wall and extending radially outwardly beyond the outer wall, the burner pan including an upwardly extending cylindrical central portion which provides said inner wall.

7. The burner assembly of claim 6 including support means mounted on the burner pan between the burner pan and said outer wall, said support means having passages for permitting fuel and air to flow therethrough.

8. The burner assembly of claim 7 in which the burner pan is generally teardrop-shaped and includes a projecting portion which extends outwardly from the support means below the fuel tube.

9. The burner assembly of claim 1 in which said support means comprises a plurality of corrugated burner rings.

10. A burner assembly for a campstove comprising a burner pan having an upwardly extending central portion having a generally cylindrical side wall with an opening therein, support means mounted on the pan for supporting a burner box, the support means having passages for permitting fuel and air to flow therethrough, a burner box mounted on said support means and having a generally cylindrical outer side wall to form a generally annular mixing chamber between the outer cylindrical side wall of the burner box and the inner cylindrical side wall of the central portion of the burner pan, and a fuel tube extending within the inner cylindrical side wall for directing fuel toward the opening in the inner side wall whereby said fuel mixes with air from within the inner side wall and the fuel and air flow through the opening in the inner side wall and a portion of the fuel and air is deflected by the outer side wall and returned through the opening in the inner side wall, and means for allowing fuel and air to flow from the annular mixing chamber.

11. The burner assembly of claim 10 in which the burner pan is generally teardrop-shaped and includes a projecting portion which extends outwardly beyond the outer side wall below the fuel tube.

12. The burner assembly of claim 10 in which a portion of the fuel tube extends over the burner pan and includes a plurality of outwardly extending fins.

13. The burner assembly of claim 10 in which the fuel tube extends through the outer side wall of the burner box, through the annular mixing chamber, and through the inner side wall of the central portion of the burner pan diametrically opposite the opening in the side wall of the burner pan.

14. The burner assembly of claim 10 in which the central portion of the burner pan includes a top wall extending across the upper end of the cylindrical side wall of the central portion.

15. The burner assembly of claim 10 in which said support means comprises a plurality of corrugated burner rings.

* * * * *